US006932344B1

(12) United States Patent
Soto

(10) Patent No.: US 6,932,344 B1
(45) Date of Patent: Aug. 23, 2005

(54) TOSSING GAME

(76) Inventor: Julio H. Soto, 4112 Garden Ave., West Palm Beach, FL (US) 33405

( * ) Notice: Subject to any disclaimer, the term of this patent is extended or adjusted under 35 U.S.C. 154(b) by 34 days.

(21) Appl. No.: 10/658,359

(22) Filed: Sep. 9, 2003

(51) Int. Cl.[7] ..... A63B 63/00
(52) U.S. Cl. ..... 273/400; 273/336; 273/398
(58) Field of Search ..... 273/118 R, 127 B, 273/127 R, 317, 336, 343, 393, 401, 402; 473/116, 569

(56) References Cited

U.S. PATENT DOCUMENTS

| | | | | | |
|---|---|---|---|---|---|
| 1,865,810 | A | * | 7/1932 | Albach | 472/126 |
| 2,287,113 | A | * | 6/1942 | Markey | 273/401 |
| 3,640,535 | A | * | 2/1972 | Gendler | 273/126 R |
| 4,203,592 | A | * | 5/1980 | Quatkemeyer | 273/336 |
| 4,736,955 | A | * | 4/1988 | Pollock | 273/336 |
| 4,989,880 | A | * | 2/1991 | Gettemeier et al. | 273/336 |
| 5,110,139 | A | * | 5/1992 | Baumgartner | 273/400 |
| 5,125,669 | A | | 6/1992 | Kanda | 273/411 |
| 5,139,272 | A | * | 8/1992 | Villafuerte | 273/348.3 |
| 5,265,884 | A | * | 11/1993 | Stein | 473/570 |
| 5,316,310 | A | * | 5/1994 | Nicholas et al. | 273/317 |
| 5,472,211 | A | * | 12/1995 | McCaughan | 273/401 |
| 5,971,396 | A | * | 10/1999 | Wieland | 273/317.1 |
| 6,015,151 | A | * | 1/2000 | Carovillano et al. | 273/317 |
| 6,131,905 | A | * | 10/2000 | Christian | 273/126 A |
| 2004/0178584 | A1 | * | 9/2004 | Fairbanks | 273/400 |

* cited by examiner

*Primary Examiner*—Gregory Vidovich
*Assistant Examiner*—Nini F. Legesse
(74) *Attorney, Agent, or Firm*—Donald J. Ersler

(57) ABSTRACT

A tossing game preferably includes an even number of tossing discs, a target disc, a retaining wire, a disc retrieval wand and a portable play surface. The tossing discs come in at least two colors and the target disc is a different color than any of the tossing discs. The retaining wire retains the discs and is also used to measure the distance between the tossing discs and the target disc. The disc retrieval wand includes a rod, a scoop and a magnetic ring. The magnetic ring is slidably engaged with the rod. The scoop is attached adjacent one end of the rod. Sand is preferably placed in the portable play surface. The portable play surface is preferably raised to accommodate play and removal of discs by the physically challenged. Each disc may be retrieved from the play surface with the magnetic ring and dropped into the scoop.

13 Claims, 4 Drawing Sheets

TOSSING GAME

BACKGROUND OF THE INVENTION

1. Field of the Invention

The present invention relates generally to games and more specially to a tossing game, which may be played by the physically challenged.

2. Discussion of the Prior Art

The prior art provides numerous tossing games. Some of these tossing games include U.S. Pat. No. 5,125,669 to Kanda and U.S. Pat. No. 6,015,151 to Carovillano et al. The Kanda patent discloses a court game apparatus and method of using same. The Kanda patent includes a transportable playing court, having non-ball-confirming boundaries. The Carovillano et al. patent discloses a booce ball type game device. The Carovillano et al. patent includes a new bocce ball type game device for playing a disc throwing game with rules similar to bocce ball.

Accordingly, there is a clearly felt need in the art for a tossing game that includes features that allow the physically challenged to play thereof.

SUMMARY OF THE INVENTION

The present invention provides a tossing game, which may be played by the physically challenged. The tossing game preferably includes an even number of tossing discs, a target disc, a retaining wire, a disc retrieval wand and a portable play surface. Each disc is preferably fabricated from a lightweight durable material, such as plastic. A tubular ferrous insert is preferably pressed into a center of each disc. The even number of tossing discs are preferably larger in diameter, but smaller in thickness than the target disc. The tossing discs come in at least two colors and the target disc is a different color than any of the tossing discs. The retaining wire preferably has a U-shape and is bent slightly on the ends thereof. The retaining wire retains the discs and is also used to measure the distance between the tossing discs and the target disc.

The disc retrieval wand includes a rod, a scoop and a magnetic ring. A handle is formed on one end of the rod and the other end of the rod is turned up. The magnetic ring is slidably engaged with the rod. The scoop is retained adjacent the handle. The portable play surface preferably has a substantially rectangular play perimeter and a side wall about the perimeter thereof. Sand is preferably placed in the portable play surface. The portable play surface is preferably raised to accommodate play and removal of discs by the physically challenged.

The tossing game is started by first placing or throwing the target disc into a center of the portable play surface. The players stand or place themselves at a predetermined distance from the portable play surface. Each team or player gets the same number of tossing discs to throw as close as possible to the target disc. The team with the tossing disc closest to the target disc wins. If two tossing discs are both very close to the target disc, the ends of the retaining wire are used to measure which tossing disc is closest to the target disc.

Each disc may be retrieved from the play surface with the disc retrieval wand. The magnetic ring is slid down to the other end of the rod. The magnetic ring is aligned with the tubular ferrous insert and dropped thereupon. The rod is tilted upward such that the magnetic ring and retrieved disc slide toward the scoop. The disc is removed from the magnetic ring and dropped in the scoop.

Accordingly, it is an object of the present invention to provide a tossing game that includes features that allow the physically challenged to play thereof.

These and additional objects, advantages, features and benefits of the present invention will become apparent from the following specification.

DETAILED DESCRIPTION OF THE PREFERRED EMBODIMENTS

Figure 1:
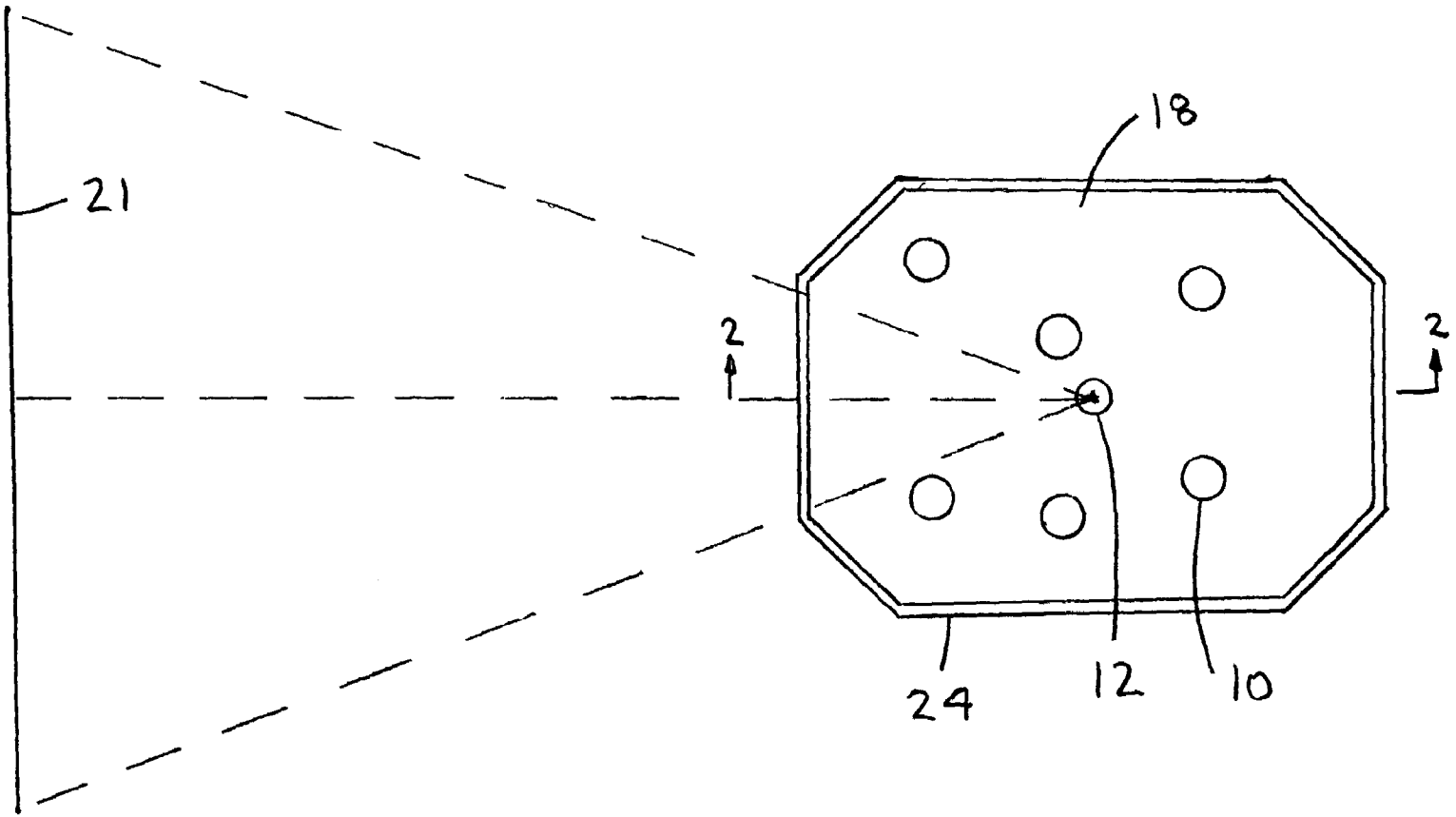
FIG. 1 is a top view of a portable play surface and tossing boundary of a tossing game in accordance with the present invention.
Figure 3:
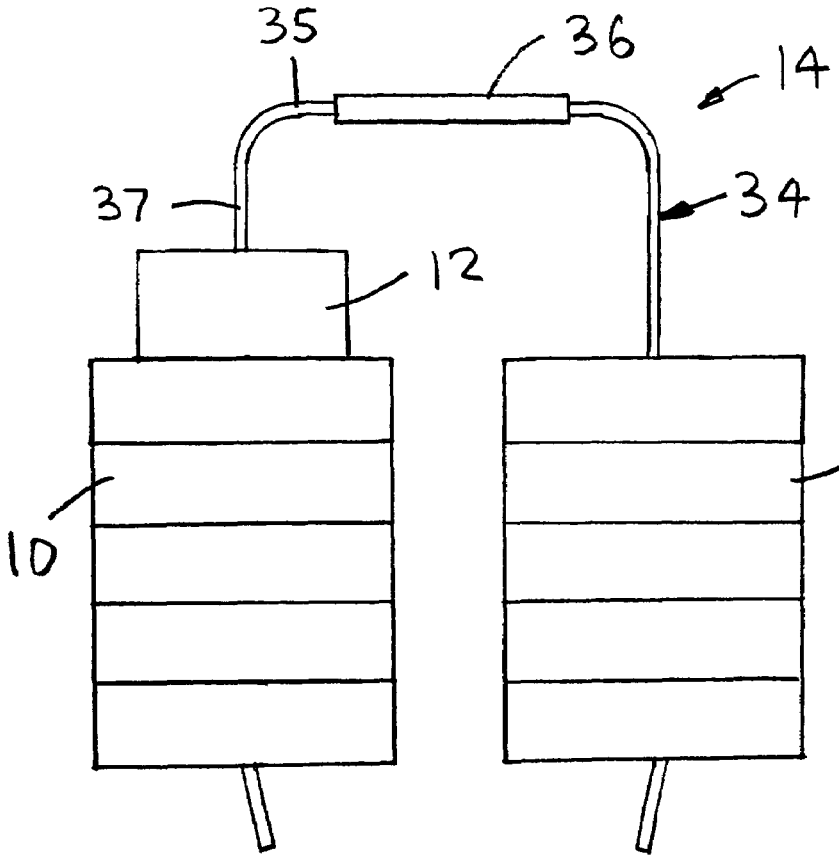
FIG. 3 is a side view of a plurality of discs retained on a retaining wire of a tossing game in accordance with the present invention.
Figure 4:
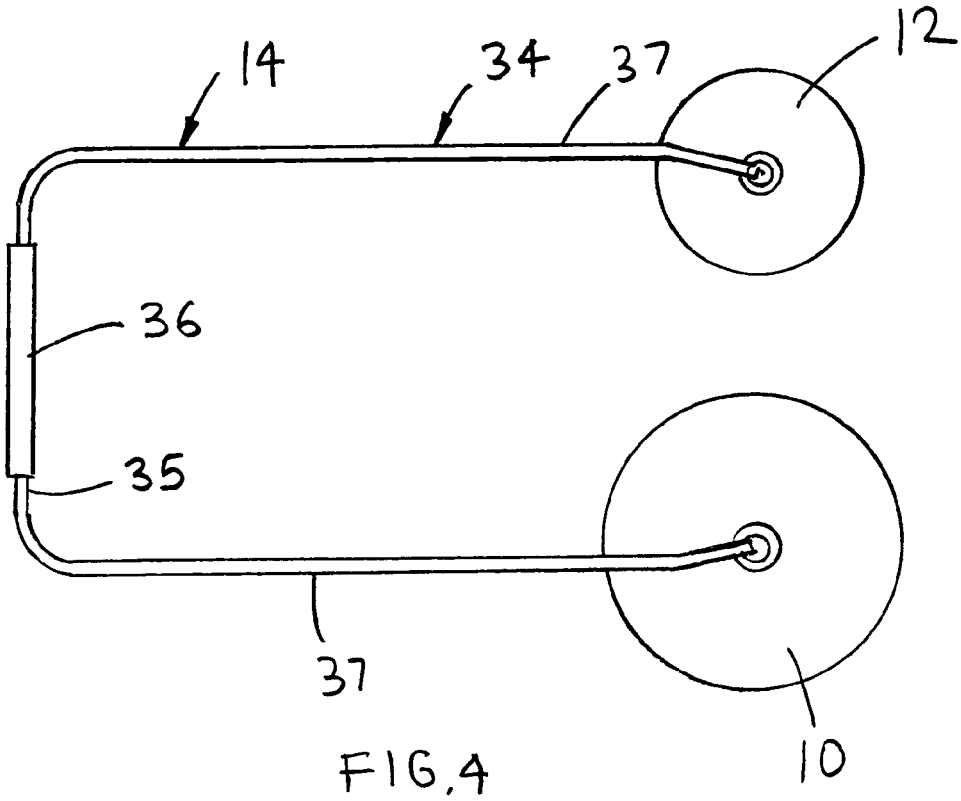
FIG. 4 is a top view of a retainer wire being used to measure the distance between a tossing disc and a target disc of a tossing game in accordance with the present invention.
Figure 5:
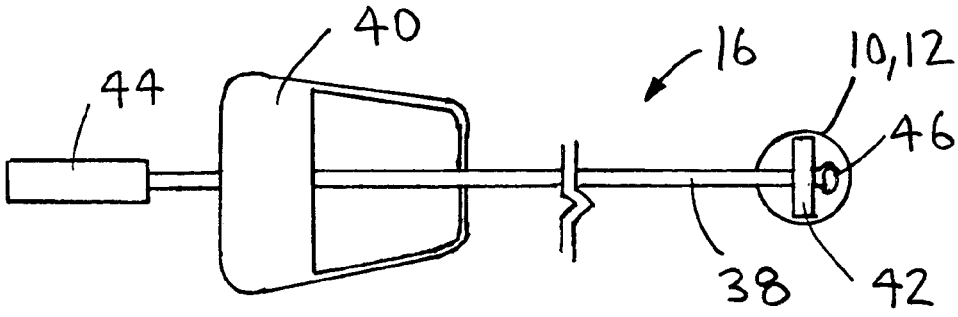
FIG. 5 is a top view of a disc retrieval wand of a tossing game in accordance with the present invention.
Figure 8:
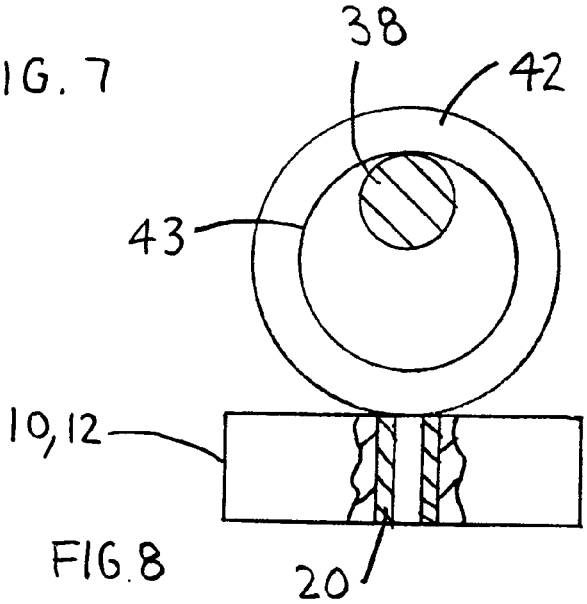
FIG. 8 is an end view of a magnetic ring retained by a rod of a disc retrieval wand of a tossing game in accordance with the present invention.

With reference now to the drawings, and particularly to FIG. 1, there is shown a top view of a portable play surface and tossing boundary of a tossing game. With reference to FIGS. 3–5, the tossing game preferably includes an even number of tossing discs 10, a target disc 12, a retaining wire 14, a disc retrieval wand 16 and a portable play surface 18. Each disc 10, 12 is preferably fabricated from a lightweight durable material, such as plastic. With reference to FIG. 8, a tubular ferrous insert 20 is preferably pressed into a center of each disc 10, 12. The even number of tossing discs 10 are preferably larger in diameter, but smaller in thickness than the target disc 12. The tossing discs 10 come in at least two colors and the target disc 12 is a different color than any of the tossing discs 10.

Figure 2:
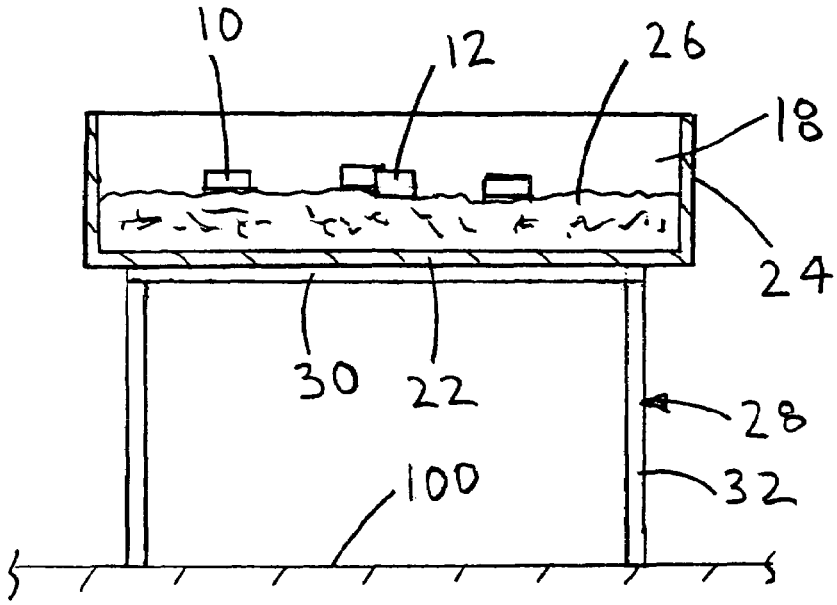
FIG. 2 is a side cross sectional view of an elevated portable play surface of a tossing game in accordance with the present invention.

A boundary 21 is defined, a set distance from a center of the portable play surface 18. Players keep their feet or the fronts of their wheel chairs behind the boundary 21, when tossing the disc 10, 12. The portable play surface 18 is shown as having a octagonal perimeter, but other shapes may also be used, such as an oval to ease access for individuals in wheel chairs. The portable play surface 18 includes a peripheral wall 24 extending upward from a base 22. With reference to FIG. 2, the portable play surface 18 is partially filled with a quantity of sand 26. The portable play surface 18 may be elevated above the ground 100 with a play support 28. The play support 28 includes at least three legs 32 extending from a base 30. However, other support devices may also be used to elevate the portable play surface 18.

The retaining wire 14 preferably includes a U-shaped wire 34 and a handle 36. The U-shaped wire 34 is preferably fabricated from a malleable material. The ends of the U-shaped wire 34 are preferably bent inward toward each other to retain the plurality of discs 10, 12. The U-shaped wire 34 includes a base wire 35 and two wire legs 37. The handle 36 is retained by the base wire 35 with any suitable method and a single wire leg 37 extends from each end of the base wire 35. The retaining wire 14 retains the discs 10, 12 and is also used to measure the distance between the tossing discs 10 and the target disc 12.

Figure 6:
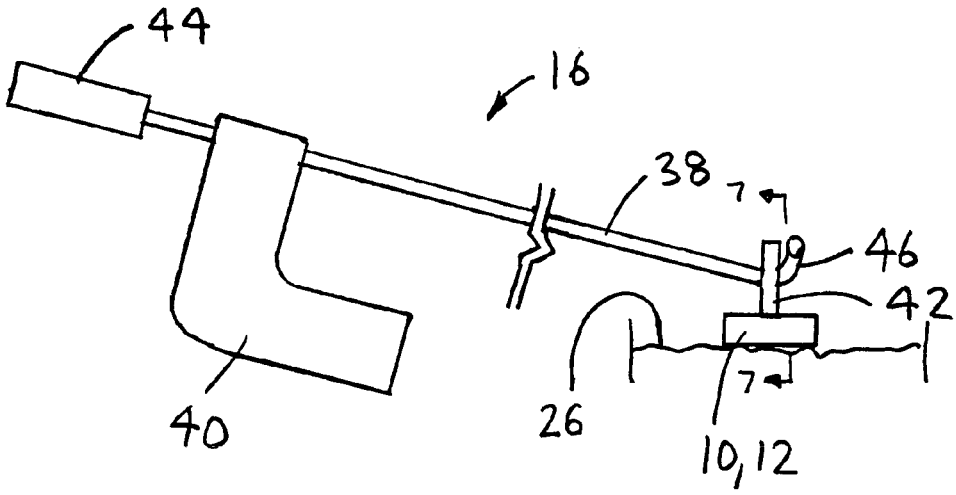
FIG. 6 is a side view of a disc retrieval wand picking-up a disc from a portable play surface of a tossing game in accordance with the present invention.
Figure 7:
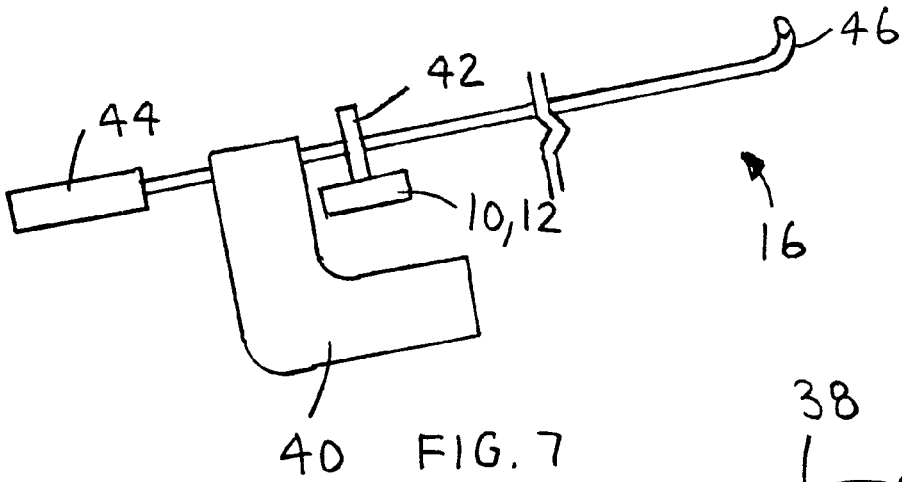
FIG. 7 is a side view of a disc retrieval wand depositing a disc into a scoop of a tossing game in accordance with the present invention.

The disc retrieval wand 16 is provided to allow the physically disabled to retrieve the discs 10, 12. The disc retrieval wand 16 includes a rod 38, a scoop 40 and a magnetic ring 42. A handle 44 is formed on one end of the rod and the other end 46 of the rod is turned up. The magnetic ring 42 is slidably engaged with the rod through an inner perimeter 43. The scoop 40 is secured to the rod 38, adjacent the handle 44. With reference to FIG. 6, the other end 46 of the rod 38 is lowered to retrieve one of the discs 10, 12. The magnetic ring 42 is placed over a center of the disc 10, 12. The magnetic force from the magnetic ring 42 draws and retains the ferrous insert 20 of the disc 10, 12. With reference to FIG. 7, the other end 46 of the retrieval wand 16 is then tilted upward, such that the magnetic ring 42 slides down the rod 38, adjacent the scoop 40. The disc 10, 12 may be removed from the magnetic ring 42 and dropped into the scoop 40.

The tossing game is started by first placing or throwing the target disc 12 into a center of the portable play surface 18. The players stand behind the boundary 21. Each team or player gets the same number of tossing discs 10 to throw as close as possible to the target disc 12. Each team or player preferably takes turns tossing one of the tossing discs 10 at the target disc 12. The team or player with the tossing disc 10 closest to the target disc 12, wins. If two tossing discs 10 are both very close to the target disc 12, the ends of the retaining wire 14 are used as shown in FIG. 4 to measure, which tossing disc 10 is closest to the target disc 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A tossing game, comprising:

at least two tossing discs and a target disc;

a portable play surface, said portable play surface being filled with a quantity of sand;

a boundary being defined for players to toss said at least two tossing discs from; and a disc retrieval wand for retrieving at least one of said discs, said disc retrieval wand including a rod, a scoop and a magnetic ring, securing said scoop to substantially one end of said rod, turning up the other end of said rod, placing said magnetic ring behind the other end of said rod, picking-up at least one of said discs with said magnetic ring.

2. The tossing game of claim 1, further comprising:

a retaining wire having a U-shape, said retaining wire holding said at least two tossing discs and said target disc.

3. The tossing game of claim 2, wherein:

the wire legs of said retaining wire being manipulated to measure, which tossing disc is closest to said target disc.

4. The tossing game of claim 1, wherein:

said portable play surface being elevated above the ground.

5. The tossing game of claim 1, wherein:

said at least two tossing discs having at least two different colors, said target disc having a different color than said at least two tossing discs.

6. The tossing game of claim 1, wherein:

said at least two tossing discs having a greater diameter, but smaller thickness than said target disc.

7. The tossing game of claim 1, further comprising:

a wall being formed around a perimeter of said portable play surface.

8. A tossing game, comprising:

at least two tossing discs and a target disc;

a portable play surface;

said portable play surface being elevated above the ground;

a boundary being defined for players to toss said at least two tossing discs from; and a disc retrieval wand for retrieving at least one of said discs, said disc retrieval wand including a rod, a scoop and a magnetic ring, securing said scoop to substantially one end of said rod, turning up the other end of said rod, placing said magnetic ring behind the other end of said rod, picking-up at least one of said discs with said magnetic ring.

9. The tossing game of claim 8, further comprising:

a retaining wire having a U-shape, said retaining wire holding said at least two tossing discs and said target disc.

10. The tossing game of claim 8, further comprising:

a wall being formed around a perimeter of said portable play surface.

11. The tossing game of claim 8, further comprising:

said portable play surface being filled with a quantity of sand.

12. A tossing game, comprising:

at least two tossing discs and a target disc;

a portable play surface;

a boundary being defined for players to toss said at least two tossing discs from; and a disc retrieval wand for retrieving at least one of said discs, said disc retrieval wand including a rod, a scoop and a magnetic ring, securing said scoop to substantially one end of said rod, turning up the other end of said rod, placing said magnetic ring behind the other end of said rod, picking-up at least one of said discs with said magnetic ring.

13. The tossing game of claim 12, wherein:

said portable play surface being elevated above the ground.

* * * * *